United States Patent [19]

Fukuma et al.

[11] 4,302,258

[45] Nov. 24, 1981

[54] COMPOSITE PROPELLANT WITH 0.2μ OR SMALLER METAL FUEL

[75] Inventors: Daizo Fukuma, Sakado; Hisao Okamoto, Sayama; Sumio Okamoto, Sayama; Takemasa Koreki, Sayama, all of Japan

[73] Assignee: Nissan Motor Company, Limited, Yokohama, Japan

[21] Appl. No.: 90,689

[22] Filed: Nov. 2, 1979

[30] Foreign Application Priority Data

Nov. 6, 1978 [JP] Japan ..... 53-136516

[51] Int. Cl.[3] ..... C06B 45/10

[52] U.S. Cl. ..... 149/19.1; 149/20; 149/21; 149/114

[58] Field of Search ..... 149/114, 19.9, 19.1–19.4, 149/20, 21

[56] References Cited

U.S. PATENT DOCUMENTS

| | | | |
|---|---|---|---|
| 2,935,394 | 5/1960 | Hiler | 149/114 |
| 3,185,601 | 5/1965 | Newman et al. | 149/114 |
| 3,310,946 | 3/1967 | Dobbins | 149/114 |
| 4,070,212 | 1/1978 | Mackey et al. | 149/19.9 |
| 4,078,953 | 3/1978 | Sayle | 149/19.4 |

*Primary Examiner*—Edward A. Miller

*Attorney, Agent, or Firm*—Schwartz, Jeffery, Schwaab, Mack, Blumenthal & Koch

[57] ABSTRACT

A composite-type propellant is disclosed. The propellant contains metal grains having an average grain size of not more than 0.2μ as an exothermic agent.

6 Claims, No Drawings

COMPOSITE PROPELLANT WITH 0.2μ OR SMALLER METAL FUEL

This invention relates to composite-type propellants, and more particularly to composite-type propellants aiming at an increase of gas evolution quantity per unit time.

In order to increase a gas evolution quantity per unit area (kg/sec.cm$^2$) of a solid propellant grain, it is necessary to increase a burning rate of the solid propellant grain under a predetermined burning pressure. For this purpose, there have hitherto been known (a) a means whereby the grain size of an oxidizing agent to be used in the solid propellant grain is reduced, (b) a means wherein an amount of metal grains added as an exothermic agent to be used for increasing a calorific value of combustion gas is decreased, and the like. In the means (a), however, if the grain size of the oxidizing agent is too small, the viscosity of the propellant slurry is excessively raised during the shaping and as a result, it is very difficult to pour the slurry into a mold. On the other hand, the means (b) has such a drawback that the temperature of combustion gas is lowered and hence an amount of energy evolved decreases.

An object of the invention is to increase a gas evolution quantity of a composite-type propellant in consideration of the above circumstances.

According to the invention, there is provided a composite-type propellant comprising metal grains with an average grain size of not more than 0.2 micron compounded as an exothermic agent.

Moreover, metal grains as the exothermic agent are known to include aluminum grains, boron grains, nickel grains, silver grains and the like.

A first embodiment of the invention will now be described with reference to the following Table 1.

In Table 1 are shown the composition, burning rate and slurry viscosity of the composite-type propellant according to the invention together with those of the conventional composite-type propellant as a comparative example. The burning rate is measured as follows; that is, a test specimen is first prepared by shaping the propellant grain into a hollow cylindrical body having an inner diameter of 40 mm, an outer diameter of 80 mm and a length of 140 mm and covering its outer peripheral surface and edge surface with epoxy resin-impregnated restrictors. Then, the test specimen is placed in a chamber provided at a central part of its rear edge with a gas exhaust port and burnt from another edge side not covered with the epoxy resin-impregnated restrictor under a burning pressure of 50 kg/cm$^2$, whereby the burning rate is estimated as a length of the test specimen burnt per second. The slurry viscosity is a value obtained by measuring a slurry having the compounding recipe of Table 1 with a Brookfield type viscometer just after the blending at 60° C.

TABLE 1

| | No. | Thickening agent *1 (wt. %) | Oxidizing agent *2 (wt. %) | Aluminum grains *3 (wt. %) Average grain size 0.2 μ | Average grain size 0.3 μ | Average grain size 0.5 μ | Average grain size 5–10 μ | Catalyst *4 (wt. %) | Burning rate (mm/sec$^6$) | Slurry viscosity (poise) |
|---|---|---|---|---|---|---|---|---|---|---|
| Example | 1 | 16 | 77 | 5 | 0 | 0 | 0 | 2 | 26 | 30,000 |
| | 2 | 16 | 72 | 10 | 0 | 0 | 0 | 2 | 30 | 30,000 |
| Comparative Example | 1 | 16 | 77 | 0 | 5 | 0 | 0 | 2 | 18 | 40,000 |
| | 2 | 16 | 77 | 0 | 0 | 5 | 0 | 2 | 16 | 43,000 |
| | 3 | 16 | 77 | 0 | 0 | 0 | 5 | 2 | 13 | 70,000 |
| | 4 | 16 | 72 | 0 | 10 | 0 | 0 | 2 | 19 | 38,000 |
| | 5 | 16 | 72 | 0 | 0 | 10 | 0 | 2 | 17 | 40,000 |
| | 6 | 16 | 72 | 0 | 0 | 0 | 10 | 2 | 10 | 50,000 |

Note
*1 terminal-carboxylated polybutadiene, made by Japan Synthetic Rubber Co., Ltd.
*2 ammonium perchlorate powder having a grain size of 10–20 μ
*3 made by vapor deposition process
*4 copper-chromium catalyst From the data of Table 1, it is proved that the burning rate of the propellant is considerably improved by limiting the average grain size of metal grains used as the exothermic agent to not more than 0.2μ. That is, when the propellant of Example 1 is compared with the propellants of Comparative Examples 1–3, the burning rate of Example 1 is 26 mm/sec. and is improved by about 45%, 62% and 100% to those of Comparative Examples 1 (18 mm/sec.), 2 (16 mm/sec.) and 3 (13 mm/sec.), respectively, even though the compouding recipe of the propellant is the same.

When the propellant of Example 2 is compared with the propellants of Comparative Examples 4–6, the burning rate of Example 2 (30 mm/sec.) is considerably improved as compared with those of Comparative Examples 4–6 like the case of Example 1 even though the compounding recipe of the propellant is the same.

Further, when comparing Comparative Example 3 with Comparative Example 6, the burning rate is raised from 10 mm/sec. to 13 mm/sec. by decreasing the compounding amount of aluminum grains from 10 wt.% to 5 wt.%, which corresponds to the aforementioned means (b). On the contrary, when comparing Example 1 with Example 2, the burning rate is raised from 26 mm/sec. to 30 mm/sec. by increasing the compounding amount of aluminum grains from 5 wt.% to 10 wt.%.

Moreover, as apparent from Comparative Examples 1, 2, 4 and 5, even when the average grain size of aluminum grains is 0.3μ or 0.5μ, the burning rate is slightly raised by increasing the compounding amount of such aluminum grains, but the effect of the increase of the compounding amount is less in the case of aluminum grains having an average grain size of 0.3–0.5μ as compared with the case of aluminum grains having an average grain size of not more than 0.2μ. Conversely, the slurry viscosity is considerably raised as compared with the case of Examples 1 and 2 and as a result, the easiness of propellant production is considerably deteriorated.

A second embodiment of the invention, will now be described with reference to the following Table 2.

In Table 2 are shown the burning test results with respect to the composite-type propellants using the above mentioned metal grains having an average grain size of 0.2μ together with aluminum grains having an average grain size of 5–10μ as an exothermic agent.

TABLE 2

| | No. | Thickening agent (wt. %) | Oxidizing agent (wt. %) | Metal grains having an average grain size of 0.2 μ(wt. %) | | Aluminum grains having an average grain size of 0.3 μ(wt. %) | Aluminum grains having an average grain size of 5–10 μ (wt. %) | Catalyst (wt. %) | Burning rate (mm/sec.) |
|---|---|---|---|---|---|---|---|---|---|
| Example | 3 | 16 | 75 | aluminum | 2 | 0 | 5 | 2 | 18 |
| | 4 | 16 | 75 | boron | 2 | 0 | 5 | 2 | 16 |
| | 5 | 16 | 75 | nickel | 2 | 0 | 5 | 2 | 15 |
| | 6 | 16 | 75 | silver | 2 | 0 | 5 | 2 | 16 |
| Comparative | 7 | 16 | 75 | 0 | | 2 | 5 | 2 | 13 |
| Example | 8 | 16 | 77 | 0 | | 0 | 5 | 2 | 13 |

Note
1. The measurement of the burning rate is the same as described in Table 1.
2. The thickening agent, oxidizing agent and catalyst are the same as used in Table 1.

The compounding recipe of Comparative Example 8 is the same as described in Comparative Example 3. On the other hand, Comparative Example 7 has such a compounding recipe that the amount of ammonium perchlorate in Comparative Example 8 is decreased by 2 wt.%, while 2 wt.% of aluminum grains having an average grain size of 0.3μ is further added. In both the cases of Comparative Examples 7 and 8, the burning rate is 13 mm/sec. as apparent from the data of Table 2.

On the contrary, when comparing Examples 3–6 with Comparative Example 7, the burning rate is 2–5 mm/sec. higher than that of Comparative Example 7 though the compounding recipe of each example is substantially the same as used in Comparative Example 7 except that 2 wt.% of aluminum, boron, nickel or silver grains having an average grain size of not more than 0.2μ is added instead of 2 wt.% of aluminum grains having an average grain size of 0.3μ. This fact shows that the metal grains having an average grain size of not more than 0.2μ, such as aluminum grains, boron grains, nickel grains, silver grains and the like can also be used together with aluminum grains having a coarser grain size according to the invention.

The mechanism of increasing the burning rate according to the invention is believed to be as follows. That is, the average grain size of metal grains as an exothermic agent is not more than 0.2μ, which is considerably smaller than the grain size of the oxidizing agent (about 10μ at minimum as mentioned below), so that there is an increased probability that such metal micrograins according to the invention enter into voids defined by the grains of the oxidizing agent, which has never been achieved by the conventional coarser metal grains. As a result, the metal micrograins drive out the thickening agent filling in the voids and enter into the voids, so that thermal transmission and conduction between the grains of the oxidizing agent are improved to increase the burning rate.

Although the invention has been described with reference to the above mentioned embodiments thereof, it will be apparent to those skilled in the art that it can be embodied in other forms without departing from the scope of the invention. For example, terminal-hydroxylated polybutadiene, polyurethanes, polyesters, polysulfites and the like may be usd as the thickening agent. As the oxidizing agent, use may be made of ammonium nitrate powder, lithium nitrate powder, lithium perchlorate powder and the like, each powder having preferably a grain size of 10–20μ. Further, iron oxide and the like may be used as the catalyst. In any case, the improvement of the burning rate can be first achieved according to the invention.

As mentioned above, by the practice of the invention the increase of burning rate or gas evolution quantity can be produced together with the increase of calorific value by compounding the metal grains having the average grain size of not more than 0.2μ as an exothermic agent into the composition of composite-type propellant.

We claim:

1. A composite-type propellant comprising metal grains as an exothermic agent, an oxidizing agent, a fuel binder and a catalyst, wherein the average size of said metal grains is not more than 0.2μ, and is selected to provide a propellant slurry viscosity during manufacture not greater than about 30,000 poise.

2. A composite-type propellant as claimed in claim 1, wherein said metal particles are selected from aluminum particles, boron particles, nickel particles and silver particles.

3. A composite-type propellant as claimed in claim 1, wherein said metal particles are used together with aluminum particles having a coarser grain size.

4. A composite-type propellant as claimed in claim 1, wherein said oxidizing agent is selected from ammonium perchlorate powder, ammonium nitrate powder, potassium perchlorate powder, lithium nitrate powder and lithium perchlorate powder, each powder having a particle size of 10–20μ.

5. A composite-type propellant as claimed in claim 1, wherein said fuel binder is selected from terminal-carboxylated polybutadiene, terminal-hydroxylated polybutadiene, polyurethane, polyester and polysulfide.

6. A composite-type propellant as claimed in claim 1, wherein said catalyst is a copper-chromate catalyst oxide.

* * * * *